US007496315B2

(12) United States Patent
Mase

(10) Patent No.: US 7,496,315 B2
(45) Date of Patent: Feb. 24, 2009

(54) IMAGE FORMING APPARATUS WITH FRONTAL DISCHARGE OF PRINT MEDIUM

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 234 days.

(21) Appl. No.: 11/564,013

(22) Filed: Nov. 28, 2006

(65) Prior Publication Data

US 2007/0122187 A1 May 31, 2007

(30) Foreign Application Priority Data

Nov. 30, 2005 (JP) ..... 2005-346616

(51) Int. Cl.
*G03G 21/16* (2006.01)

(52) U.S. Cl. ..... 399/111

(58) Field of Classification Search ..... 399/107, 399/111, 113, 114, 397, 405
See application file for complete search history.

(56) References Cited

U.S. PATENT DOCUMENTS 5,661,567 A * 8/1997 Maeda et al. ..... 358/400
5,758,232 A 5/1998 Ikunami
6,304,742 B1 * 10/2001 Nunes et al. ..... 399/361
7,298,988 B2 * 11/2007 Nakayama ..... 399/110

FOREIGN PATENT DOCUMENTS

| | | |
|---|---|---|
| JP | 5-134502 | 5/1993 |
| JP | 5-207211 | 8/1993 |
| JP | 9-179406 | 7/1997 |
| JP | 9-230653 | 9/1997 |
| JP | 2001-209220 | 8/2001 |
| JP | 2005-017425 | 1/2005 |
| JP | 2005-173171 | 6/2005 |

* cited by examiner

*Primary Examiner*—Hoan H Tran
(74) *Attorney, Agent, or Firm*—Banner & Witcoff, Ltd

(57) ABSTRACT

A multifunctional machine includes an image forming unit and an image reading unit. Of them, the image reading unit is held on a body case with a longitudinal direction of an original placing part on which an original is rested and placed being along a width direction of an apparatus and in a state in which the image reading unit is inclined downward to the back side from the front side of the apparatus. A front surface wall of the body case is an openable and closable front cover, and is structured so that a process unit housed inside can be removed from a front side of the apparatus by opening it. Recording paper on which an image is formed in the image forming unit is discharged onto the image reading unit.

20 Claims, 9 Drawing Sheets

IMAGE FORMING APPARATUS WITH FRONTAL DISCHARGE OF PRINT MEDIUM

CROSS REFERENCE TO RELATED APPLICATION

This application claims priority from Japanese Patent Application No. 2005-346616 filed Nov. 30, 2005. The entire content of this priority application is incorporated herein by reference.

TECHNICAL FIELD

The disclosure relates to an image forming apparatus.

BACKGROUND

Image forming apparatuses including original reading functions have been proposed.

One type of image forming apparatus is can be referred to as an in-body paper discharge type of image forming apparatus. This apparatus includes a laser printer as an image forming part body, and a flatbed scanner as an image reading part, and a discharge tray located between both of them. This type of apparatus is provided with a cartridge cover at a front surface of the apparatus, so that a toner cartridge can be taken out by opening it. On the other hand, other types of apparatuses do not adopt the in-body paper discharge structure, but are constructed to discharge recording paper on flatbed scanners.

Since an in-body paper discharge type of image forming apparatus is provided with a medium discharge mechanism (which discharges recording paper, between the image forming part body and the flatbed scanner), the height of the overall apparatus increases which decreases the operability of the device as a whole.

Meanwhile, an image forming apparatus, having a discharging recording paper on the flatbed scanner, can be reduced in height by and large, but has poor usability such as maintainability and operability. However, in this configuration, the flatbed scanner is disposed directly above the toner cartridge to be in close proximity to it to realize reduction in height, as a result of which, the space in front of the toner cartridge cannot be sufficiently secured, and the cartridge cannot be taken out from the front side of the apparatus.

Thus, there is a need in the art to provide an image forming apparatus which is reduced in size of the apparatus and also excellent in usability.

SUMMARY

An image forming apparatus of the present invention can include the following elements.

An image forming unit includes a body case,a process unit including an image carrier, and is attachably and detachably mounted to an inside of the aforesaid body case, a front cover that opens and closes the process unit removal port of the aforesaid body case, a medium cassette that is positioned at the body case, and includes the recording medium in a stacked state with its longitudinal direction being along a depth direction of the apparatus, an exposing device positioned inside the body case, the exposing device including a light source, and which is able to perform and exposure of the image carrier. The image forming apparatus can also include a developing device positioned inside the body case, and the developing device able to transfer an image carried by the image carrier to the recording medium, and an image reading unit positioned over the image forming unit, the image reading unit including an original placing part on which an original for reading an image is placed, a reading device that is provided under the original placing part to read the original, an original cover that presses the original placed on the original placing part from above, and a medium discharge mechanism positioned above the original cover and discharges the recording medium.

According to the present invention, the recording medium is discharged onto the original cover, and therefore, reduction in height of the apparatus is made possible as compared with the construction (in-body paper discharge type) in which a paper discharge space is specially provided inside the apparatus. Discharge of the recording medium is performed from the back side of the apparatus to the front side, and further, the process unit can be removed from the front side of the apparatus by opening and closing the front cover. Removal of the process unit and removal of the recording medium after image formation are both performed from the front side of the apparatus like this, and therefore, usability such as accessibility and maintainability is enhanced.

BRIEF DESCRIPTION OF THE DRAWINGS

Illustrative aspects in accordance with the invention will be described in detail with reference to the following figures wherein.

DETAILED DESCRIPTION

An illustrative aspect of the present invention will be described with reference to FIGS. 1 to 7.

Figure 1:
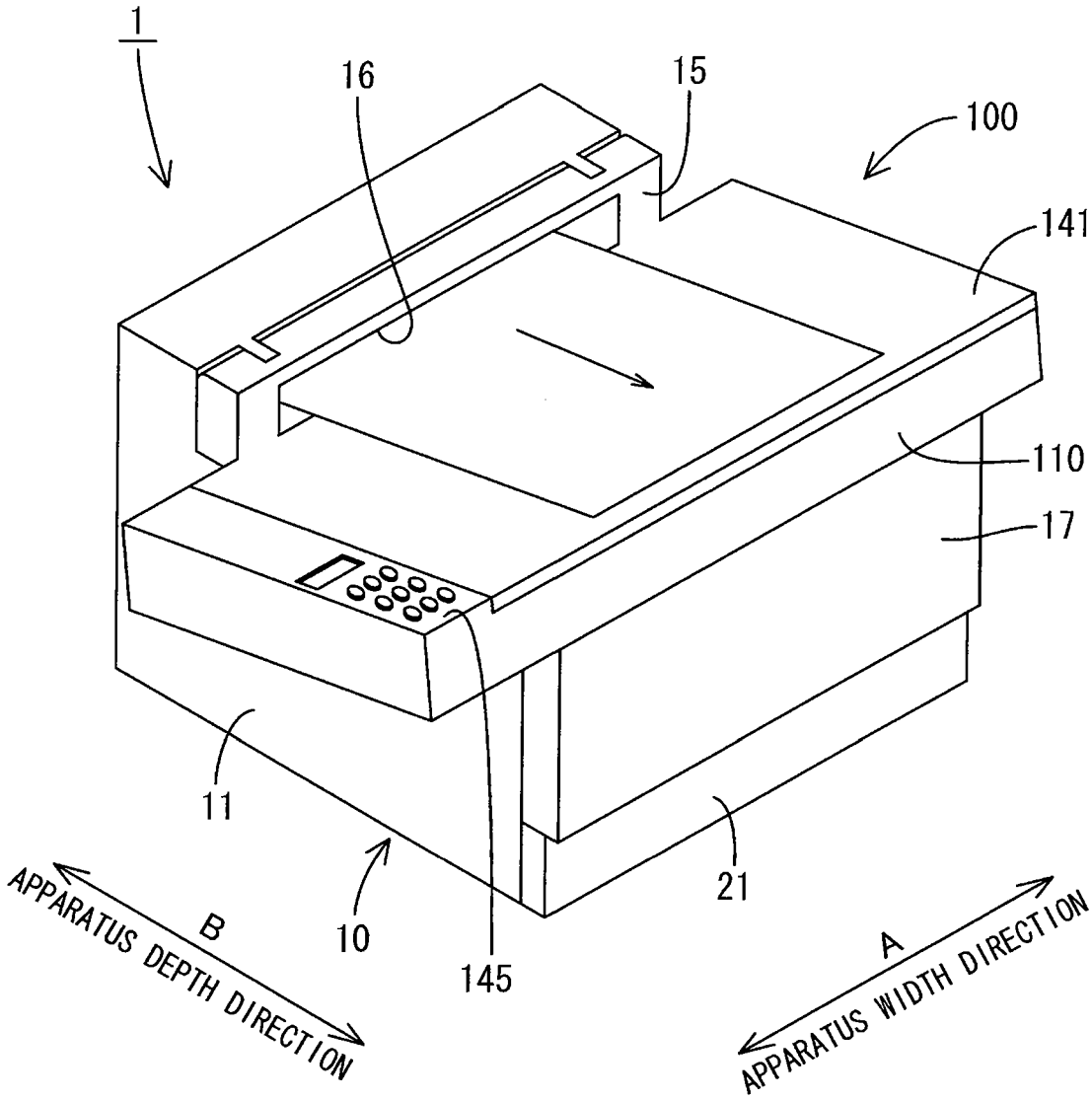
FIG. 1 is a perspective view showing a schematic construction of a multifunctional machine according to one aspect of the invention.

FIG. 1 is a perspective view of a multifunctional machine 1 applied to this illustrative aspect. The multifunctional machine 1 can include an image reading unit 100 positioned on an upper side of an image forming unit 10 having a body case 11. Note that in the following description, the direction of the arrow A shown in FIG. 1 is set as the width direction of the apparatus, and the direction shown by the arrow B is set as the depth direction of the apparatus. An operation panel 145 can be positioned at an upper left portion of the apparatus, and in the direction of the arrow B in FIG. 1, the side where the operation panel 145 is positioned is set as the front (front side) of the apparatus. The image forming unit 10 will now be described, and thereafter, the image reading unit 100 will be described.

<Image Forming Unit>

Figure 2:
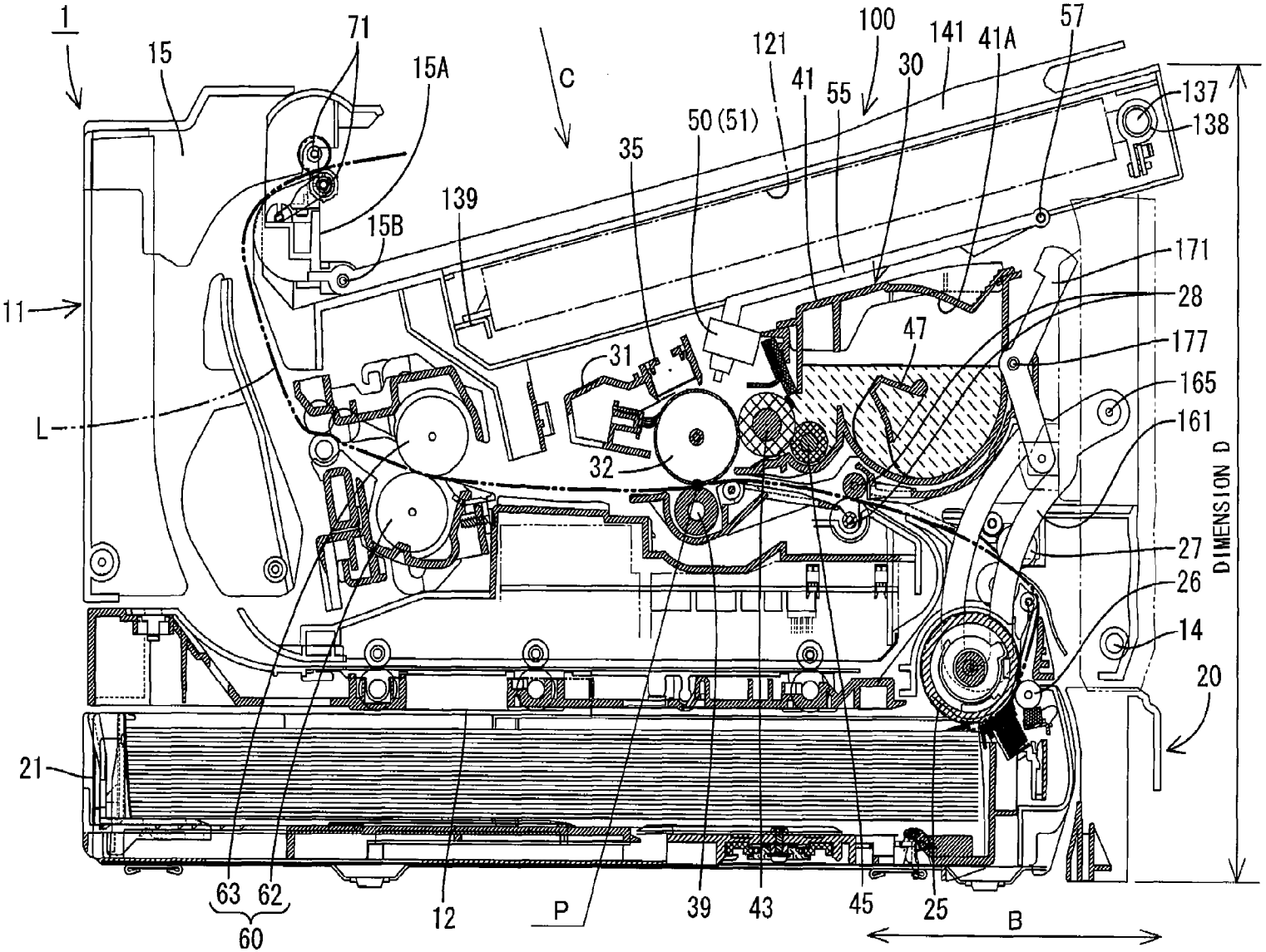
FIG. 2 is a vertical sectional view of the multifunctional machine.

FIG. 2 is a vertical sectional view of the multifunctional machine 1. The image forming unit 10 can include a feeder part 20, a process unit 30, an LED array 50 as an exposing device, a fuser 60 and the like.

The feeder part 20 includes a medium cassette 21 forming a thin tray shape. The medium cassette 21 houses recording paper as a recording medium in a stacked state with its longitudinal direction aligned with the depth direction of the apparatus, and is constructed to be attached to and detached from a cassette housing part 12 positioned at a lower portion of the body case 11.

A paper feed roller 25 and a pinch roller 26 can be positioned at a lower front portion of the body case 11 and at a front side of the medium cassette 21, so as to draw out the recording paper one by one from the medium cassette 21 to the front side, and thereafter, feed it out to a conveyance route (shown by the two-dot chain line in FIG. 2) L while causing it to change direction to the back side of the body case 11. Reference numeral 27 in FIG. 2 designates a transfer roller and reference numeral 28 designates resisting rollers for correcting skew of the recording paper.

Figure 6:
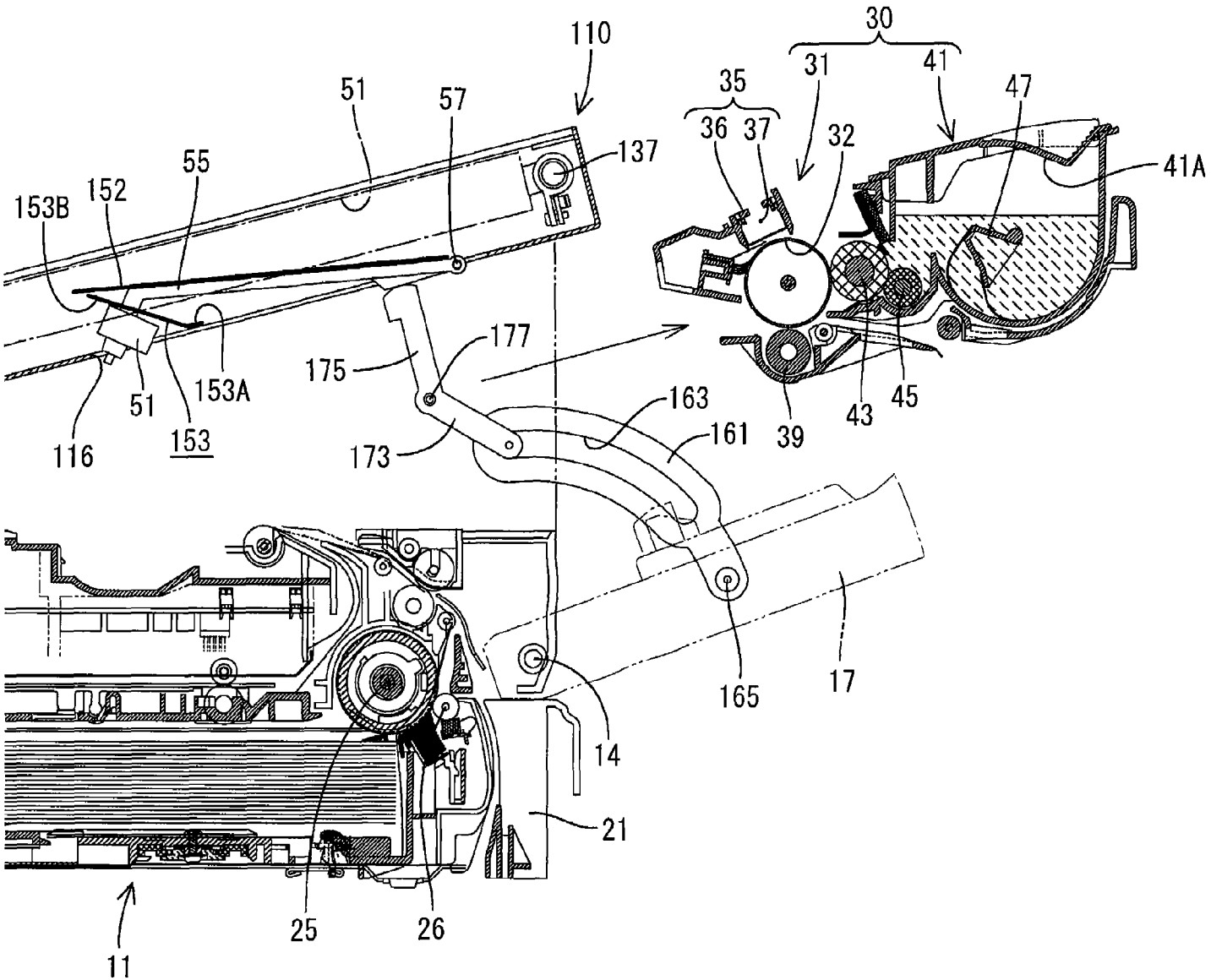
FIG. 6 is a sectional view showing an attaching and detaching operation of the process unit.

A process unit 30 can be positioned above the medium cassette 21, and can include a drum cartridge 31 and a developing cartridge 41. As shown in FIGS. 2 and 6, the drum cartridge 31 can include a photosensitive drum 32 that is an image carrier, a charger 35 and a transfer roller 39. The photosensitive drum 32 can be structured in a cylindrical shape extending along a width direction of the recording paper (direction perpendicular to the paper face in FIG. 2), with its surface portion formed by a photosensitive layer with a positive electrification characteristic, and can be composed of polycarbonate or the like. The photosensitive drum 32 can be rotationally driven by power from a main motor not shown.

The charger 35 can be a scorotron charger, which can include a charging wire 37 in a shield case 36. A high voltage is applied to the charging wire 37, and thereby, corona discharge is generated. The charger 35 has the function of uniformly charging the surface of the photosensitive drum 32 to positive polarity by applying constant voltage to a grid on the occasion of electric discharge.

The transfer roller 39 can be positioned opposite the photosensitive drum 32 under the photosensitive drum 32. The transfer roller 39 can include a metal roller shaft covered with a roller formed from a rubber material with an ion conductive property, and is constructed so that a transfer bias (transfer forward bias) is applied thereto at the time of transfer.

The developing cartridge 41 can include a development roller 43 and a supply roller 45 at a lower portion of a toner casing 41A which houses a toner. The developing roller 43 and the supply roller 45 can be positioned opposite each other. An agitator 47 for agitating the toner is provided in the toner casing 41A. The toner released from the toner casing 41A is supplied to the development roller 43 by the rotation of the supply roller 45, and when the toner passes between both of them, the toner is triboelectrically charged to positive polarity by friction accompanying the rotation. The triboelectrically charged toner is supplied to the photosensitive drum 32 by the development roller 43. Though the detail will be described later, the process unit 30 can be attached to and detached from the body case 11 by the operation from the front side of the apparatus.

Next, the LED array 50 that is an exposing device will be described.

Figure 3:
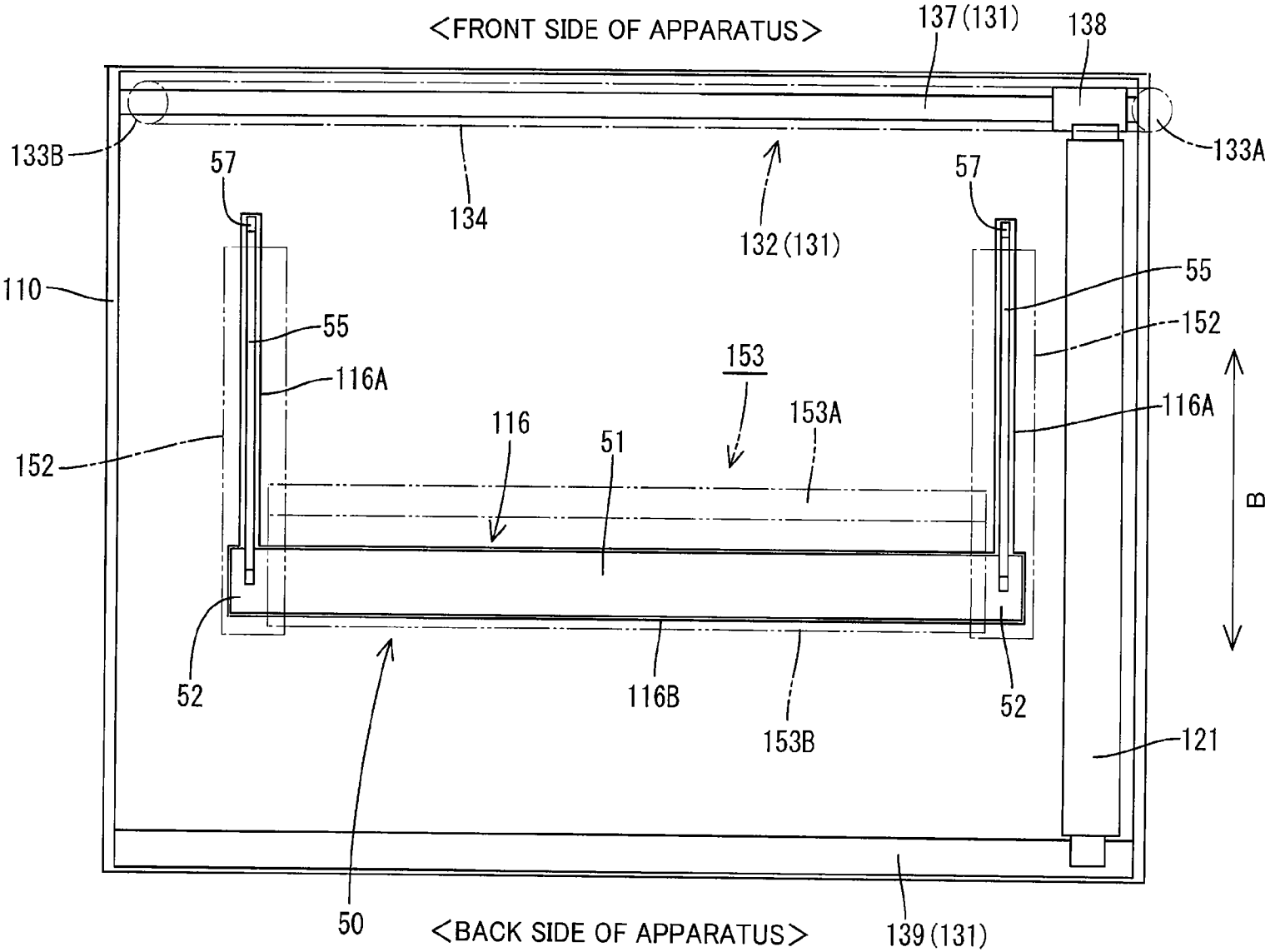
FIG. 3 is a plan view of FIG. 2 seen from direction C.
Figure 4:
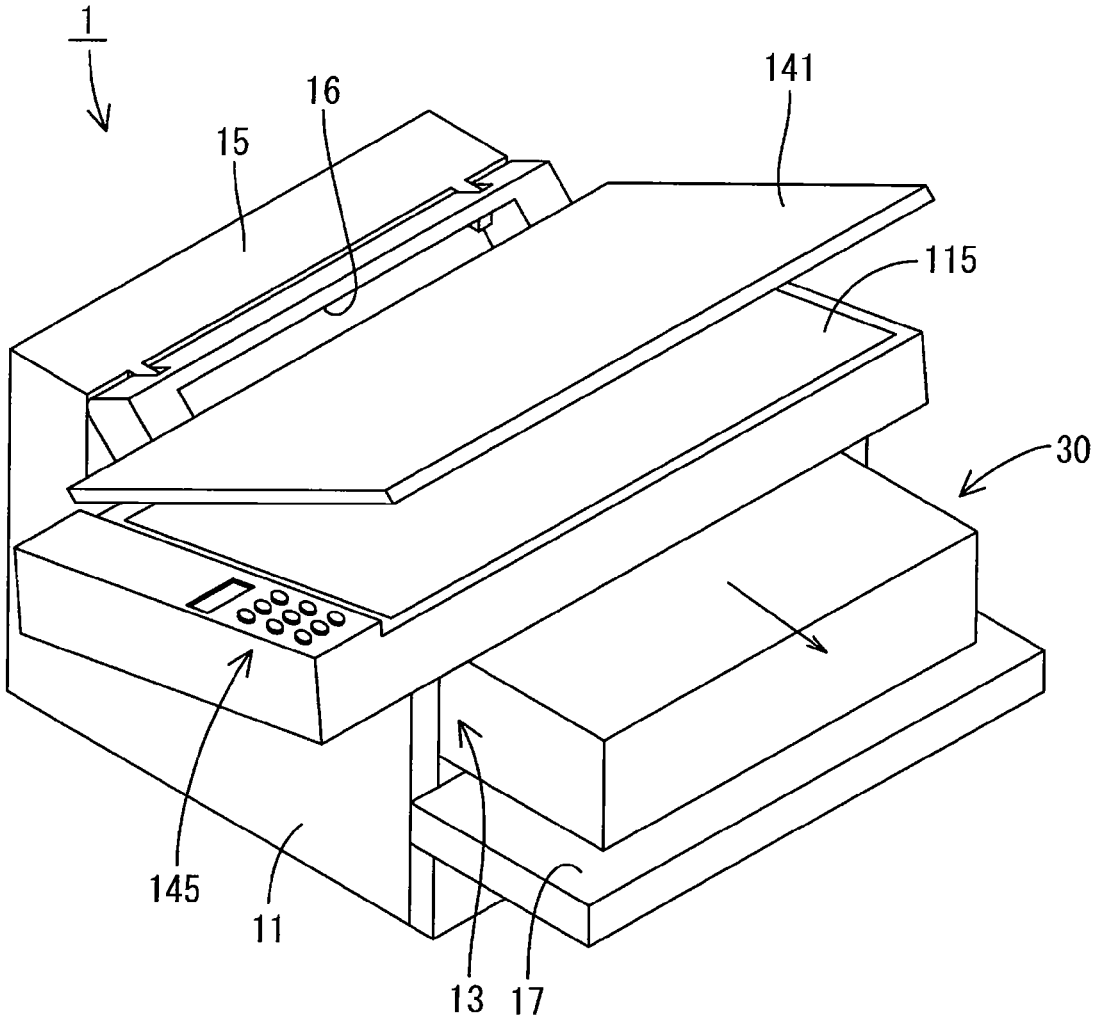
FIG. 4 is a perspective view showing an attaching and detaching operation of a process unit.

The LED array 50 irradiates light via a predetermined timing to expose the photosensitive drum 32, and is positioned at an exposure position with a light projecting surface directed to the photosensitive drum 32 above the photosensitive drum 32 (position at which it enters a gap between the toner casing 41A and the charger 35), as shown in FIG. 2. More specifically, the LED array 50 has a plurality of LEDs (point light sources) aligned on a base board 51 extending along the axial direction of the photosensitive drum 32 (the lateral direction) as shown in FIG. 3. Though not shown in detail, the total length of the base board 51 can be longer than the total length of the photosensitive drum 32, and both ends 52 in the longitudinal direction protrude sideward from the photosensitive drum 32.

A pair of support arms 55 can be connected to the protruded end portions 52 to support the LED array 50, but only one side will be described here since the support structures are the same at both sides.

The shape of the support arm 55, as seen from the side face and as shown in FIG. 2, forms the shape bent at the intermediate portion, and a left end portion shown in FIG. 2 is a connecting portion to the base board 51. Meanwhile, a hinge shaft 57 is positioned at an upper portion of a side face wall of the body case 11, and the other end of the support arm 55 is rotatably connected thereto. An arm holder (not shown) is positioned at the body case 11. The arm holder has the function of holding the support arm 55, for example in the posture shown in FIG. 2, by supporting a part of the support arm 55 near to the tip end from below.

Next, fuser part 60 will be described.

The fuser part 60 can be positioned behind the process unit 30. The fuser part 60 can include a heating roller 63 and a pressure roller 62 which can be positioned opposite the heating roller 63. The heating roller 63 includes a halogen lamp (not shown) for heating, and heat-fuses the toner image (developer image) transferred onto the recording paper by the transfer roller 39 while the recording paper passes between the heating roller 63 and the pressure roller 62.

Next, a brief description of a series of image forming operations. First, the surface of the photosensitive drum 32 is uniformly charged positively by the charger 35 with its rotation. Thereafter, when a predetermined image data is inputted from, for example, a higher-level apparatus, control based on the image data is started, and light is irradiated to the photosensitive drum 32 from the LED array 50. Thereby, a predetermined electrostatic latent image corresponding to the image data is formed on the surface of the photosensitive drum 32. Namely, of the surface of the photosensitive drum 32 positively charged uniformly, the electric potential of the portion irradiated with light lowers (so-called exposure).

Subsequently, by the rotation of the development roller 43, the toner, which is carried on the development roller 43 and positively charged, is supplied to the electrostatic latent image formed on the surface of the photosensitive drum 32. Thereby, the electrostatic latent image of the photosensitive drum 32 is made a visible image, and a toner image by reversal development is carried on the surface of the photosensitive drum 32.

In parallel with the processing for forming the above described toner image, the processing of conveying the toner image to a medium, or paper, is performed. By rotating the paper feed roller 25, the recording paper is fed to the conveyance route L one by one from the medium cassette 21. The recording paper, which is fed out to the conveyance route L, is carried to a transfer position (the point at which the photosensitive drum and the transfer roller contact) P by the conveyer roller 27. When the recording paper passing through the transfer position P, the toner image carried on the surface of the photosensitive drum 32 is transferred to the surface of the recording paper by transfer bias applied to the transfer roller 39. Thus, a desired toner image is formed on the recording paper. Thereafter, the transferred toner image is heat-fused when passing through the fuser part 60.

After the image formation process, the recording paper is discharged onto an original cover 141 of an image reading unit 100 which will be described next. Namely, as shown in FIG. 2, the image reading unit 100 is positioned in the state in which it is inclined downward to the back side from the front side (front) of the apparatus, and a step part 15 is positioned at the rear portion of the body case 11. On a front wall 15A of the step part 15, a paper discharge port 16 positioned near a top surface of the image forming unit 100 is opened along the width direction of the apparatus as shown in FIG. 1, and a paper discharge roller, that is, a medium discharge mechanism 71 is further provided at an opening edge portion of the paper discharge port 16, as shown in FIG. 2.

Meanwhile, the conveyance route L changes its direction to an upward direction at the rear portion of the body case 11 to take the route continuing to the paper discharge roller 71. Thus, when reaching the step portion 15 of the body case 11, the recording paper (after image formation) is fed out to the tip end side of the apparatus from the paper discharge port 16 by the paper discharge roller 71 to be discharged onto the original cover 141 of the image reading unit 100.

<Image Reading Unit>

The image reading unit 100 is a flatbed type image reading device, and can include an image sensor 121 that is a reading device, and an advance and retreat mechanism 131 inside a box type housing case 110. A top surface of the housing case 110 includes an original placing part 115, the original placing part 115 preferably made of platen glass, on which an original paper is positioned to be copied. Further, a portion opposed to the base board 51 of the LED array 50 and the support arm 55 is opened as a receiving port 116 which receives the LED array 50 (see FIG. 3).

The image reading unit 100 is held on the abovementioned body case 11, with the longitudinal direction of the original placing part 115, along the width direction of the apparatus (direction A in FIG. 1) as shown in FIG. 1, and in the state in which it is inclined downward toward the back side from the front side of the apparatus as shown in FIG. 2.

Original cover 141 (see FIG. 1) is also used as the paper discharge tray, and is capable of closing over the top surface of the original placing part 115. The original cover 141 has a rear end connected to the hinge shaft 15B provided at the lower portion of the step part 15, and is constructed to be opened by operation from the front side of the apparatus. Namely, by lifting the front edge of the cover 141 upward, the original placing part 115 is exposed, so that an original can be set thereon (see FIG. 4). The operation panel 145 is positioned next to the original cover 141. The operation panel 145 is used when various kinds of settings such as the number of copies, for example, are changed. Note that an original is set on the platen glass 115 in the lateral orientation, namely, with the longitudinal direction of the original facing the longitudinal direction of the platen glass 115.

Next, the image sensor 121 and the advance and retreat mechanism 131 will be described. FIG. 3 is a plan view of FIG. 2 seen from the direction C. The image sensor 121 is a so-called line sensor with light receiving photodiodes (not shown) positioned in one direction, and positioned in the housing case 110 with its longitudinal direction facing a direction perpendicular to the longitudinal direction of the platen glass 115 (vertical direction in FIG. 3). The image sensor 121 is provided with a light source (not shown) as an illumination device. The light, which is emitted from the light source, is irradiated onto the original which is positioned on original placing part 115, and the light reflected off the original is received by the individual photodiodes.

Thereby, an electric signal at the level corresponding to the light intensity (lightness) of the received light is outputted from each of the photodiodes. By converting the signal into digital data by an A/D converter not shown, the image of the portion irradiated with light, of the original can be read. Further, scanning the image sensor 121 in a longitudinal direction of the original (lateral direction in FIG. 3) by the advance and retreat mechanism 131 which will be described next, the image of the entire original can be read.

The advance and retreat mechanism 131 can include a drive part 132 which applies a drive force to the image sensor 121, and a pair of guide members 137 and 139 which guide advance and retreat movement of the image sensor. Of the guide members, the one that is located on the upper side in FIG. 3 is the main guide 137. The main guide 137 forms a columnar shape, and a cylindrical slider 138 is fitted to its outer periphery to be able to advance and retreat. One end of the image sensor 121 is connected to the slider 138. Further, of the guide members, the one that is located at the lower side in FIG. 3 is the sub guide 139. The sub guide 139 can be configured as a flat shape, and the other end of the image sensor 121 is overlaid on its top surface.

The drive part 132 is a power converting device which converts the rotation transmitted from the drive force of the main motor not shown into reciprocating motion along the lateral direction in FIG. 3, and can include, for example, a pair of pulleys 133A and 133B, and an endless belt 134 stretched around both of them. When the power from the main motor is transmitted at the time of reading an original, the power is converted into a reciprocating motion by the drive part 132, and is transmitted to the image sensor 121. Thereby, the image sensor 121 receives guiding action by the guide members 137 and 139, and smoothly advances and retreats in the lateral direction shown in FIG. 3.

When the image sensor 121 is not smoothly advanced or retreated, the image sensor 121 is restrained from moving by the drive part 132, and is kept at a side edge portion (more specifically, a right side edge portion in FIG. 3) of the housing case 110, as shown in FIG. 3. By retreating the image sensor 121 to the side portion of the housing case 110 when an original reading operation is not performed, an area of a central portion of an internal space of the housing case 110 is opened. Thereby, the LED array 50 can be received inside (details will be described next) through the receiving port 116 on the bottom of the housing case 110.

Returning to the prior explanation of the image forming unit 10 again, the front wall of the body case 11 is the front cover 17 as shown in FIGS. 1 and 2. The front surface of the body case 11 is structured to open as a process unit removal port 13, and the front cover 17 is mounted thereto so as to close the opening. The front cover 17 is connected to the body case 11 by a hinge 14 provided at the front end lower portion of the case. As a result, by manipulating a position near the upper end of the front cover 17, the front cover 17 is displaced from a closed posture shown in FIG. 1 to an open posture shown in FIG. 4, thereby being able to open the process unit removal port 13, or the cover is displaced from the open posture to the closed posture to be able to close the process unit removal port 13.

Reference numeral 161 shown in FIG. 2 designates an introduction link, and reference numeral 171 designates a linkage link. The introduction link 161 is supported at the front cover 17 swingably around a hinge shaft 165, while the linkage link 171 is supported at the body case 11 swingably around a hinge shaft 177.

Figure 5:
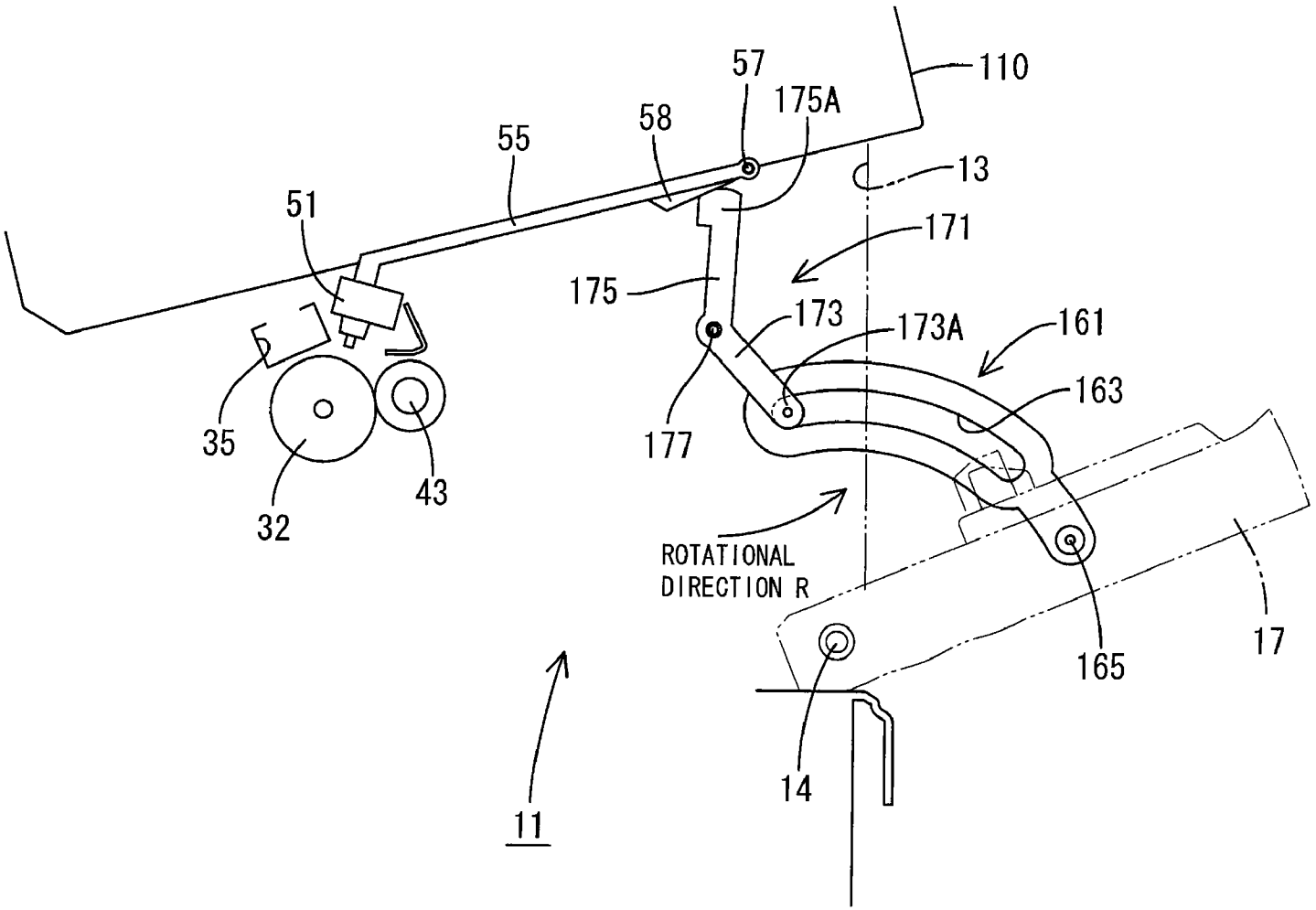
FIG. 5 is a side view showing a retreating operation of an LED array.

As shown in FIG. 5, the linkage link 171 can include a pair of arms 173 and 175 extending in the reverse direction from each other. A cam pin 173A is fixed to a lower end of the lower arm 173, and an upper end of the upper arm 175 is made a push-down part 175A which is formed into an arc shape.

Meanwhile, the introduction link 161 can include a cam groove 163 forming an arc shape. The cam pin 173A is fitted in the cam groove 163, and thereby, the introduction link 161 and the linkage link 171 are operably linked with each other. As shown in FIG. 2, the cam pin 173A is set at the groove end at the upper side of the cam groove 163 in the state in which the front cover 17 is closed, so that the push-in part 175A is opposed to an abutting part 58 provided at a base end of the support arm 55.

By constructed as described above, when the front cover 17 is opened (i.e. displaced from the posture shown in FIG. 1 to the posture shown in FIG. 4), the LED array 50 in the exposure position shown in FIG. 2 can be automatically retreated to the retreat position inside the housing case 110.

More specifically, when the front cover 17 is opened from the posture shown in FIG. 1, the introduction link 161 is drawn out in the right direction in FIG. 1 with the cover 17. Therefore, while the cam pin 173A is moving along the axial direction of the groove inside the guide groove 163, the introduction link 161 rotationally displaces around the hinge shaft 165. Then, the cam pin 173A reaches the end portion at the left side of the cam groove 163. When the front cover 17 is further opened thereafter, the cam pin 173A is lifted diagonally upward to the right in FIG. 5 through the groove end of the cam groove 163, and as a result, the linkage link 171 rotates in the direction R shown in FIG. 5 around the hinge shaft 177.

Thereby, the push-in part 175A of the linkage link 171 is positioned next to the abutting part 58 of the support arm 55, and pushes up the support arm 55. Thus, the support arm 55 rotates in the clockwise direction around the hinge shaft 57, and thereby, the LED array 50 advances into the housing case 110 through the receiving port 116 of the housing case 110.

When the front cover 17 reaches the open posture shown in FIG. 6, the LED array 50 reaches the retreat position inside the housing case 110. The LED array 50 in the state retreats from the process unit 30, thus the process unit 30 can be attached and detached from the removal port 13 at the front of the body case 11 without interfering with the other components.

The retreat position of the LED tray 50 is provided inside the housing case 110, and the image sensor 121 is housed in the housing case 110, but when the reading operation is not performed, the image sensor 121 is positioned at the side edge portion inside the case as shown in FIG. 3, and therefore, the LED array 50 does not interfere with the image sensor 121.

When the receiving port 116 is provided in a part of the housing case 110, there is the possibility of entry of disturbance light, which enters from the receiving port 116, onto the photosensitive drum 32. The following measures can be taken to prevent or significantly reduce entry of such disturbance light (especially during exposure).

First, as shown by the two-dot chain line in FIG. 3 (the solid line in FIG. 6), a first PET film (black film of polyethylene telephthalate) 152 is attached to each support arm 55 by bonding or the like.

The first PET film 152 forms a shape (shape extending to be slim and long vertically in FIG. 3) capable of closing a portion 116A in which the support arm 55 is housed, of the receiving port 116. When the LED array 50 is located at the exposure position (see FIG. 2), the support arm 55 is positioned inside the receiving port 116, and therefore, the portion 116A housing the support arm 55, of the receiving port 116 is brought into the closed state by the first PET film 152 bonded onto the support arm 55.

Meanwhile, of the receiving port 116, a portion 116B corresponding to the base board 51 of the LED array 50 is closed by a second PET film 153. The second PET film (black film of polyethylene telephthalate) 153 forms a shape (shape laterally long in FIG. 3) capable of closing the portion 116B, in which the base board 51 is housed, of the receiving port 116.

Of the second PET film 153, an edge portion 153A at the lower side in FIG. 3, is connected to a port edge portion of the receiving port 116 (a lower surface wall of the housing case 110) by bonding or the like in the range of its entire width, but the other portions are not bonded to any component and are free.

When the LED array 50 is located at the retreat position (see FIG. 6), the second PET film 153 is pushed from below by the base board 51, and is elastically deformed inside the housing case 110 and bent so that the non-bonded end side is lifted up. However, when the LED array 50 reaches the exposure position, the pressing force by the baseboard 51 is released. As a result, the second PET film 152 returns to the state before deformation (flat state). Thereby, of the receiving port 116, the portion 116B corresponding to the base board 51 is closed by the second PET film 153.

When the LED array 50 is in the exposure position, the entire receiving port 116 is covered with the first and the second PET films 152 and 153 as described above, and therefore, entry of disturbance light during exposure can be prevented or significantly reduced. The end portion (the lower end shown in FIG. 3) of the first PET film 152, and the end portion (both the left and right ends shown in FIG. 3) of the second PET film 153 are set to partially overlap each other so as to enhance the sealing property.

According to this illustrative aspect, the apparatus can be reduced in height as compared with an in-body paper discharge type of apparatus. In addition, in the apparatus of this illustrative aspect, the image reading unit 100 is mounted in the state in which it is inclined downward from the front (front side) toward the back side.

In the apparatus in which the recording paper is discharged onto the original cover 141, the paper discharge port 16 and the paper discharge roller 71 are positioned at higher positions than the original cover 141. If the image reading unit 100 is disposed horizontally without being inclined, the paper discharge port 16 and the paper discharge roller 71 cannot be placed within the dimension Din FIG. 2, and the total height of the apparatus exceeds the dimension D.

However, in this illustrative aspect, the paper discharge port 16 and the paper discharge roller 71 are all placed within the dimension D in FIG. 2 by inclining the image reading unit 100 downward to lower the rear end position of the original cover 141, and thus, image reading unit 100 is able to realize a reduction in height. In addition, the recording paper which is discharged onto the original cover 141 is discharged while being pushed out diagonally upward as in the conventional paper discharge tray, and therefore, favorable stacking performance (loading performance) is provided. The retreat position of the LED array 50 inside the housing case 110 also contributes to reduction in height of the apparatus.

Figure 7:
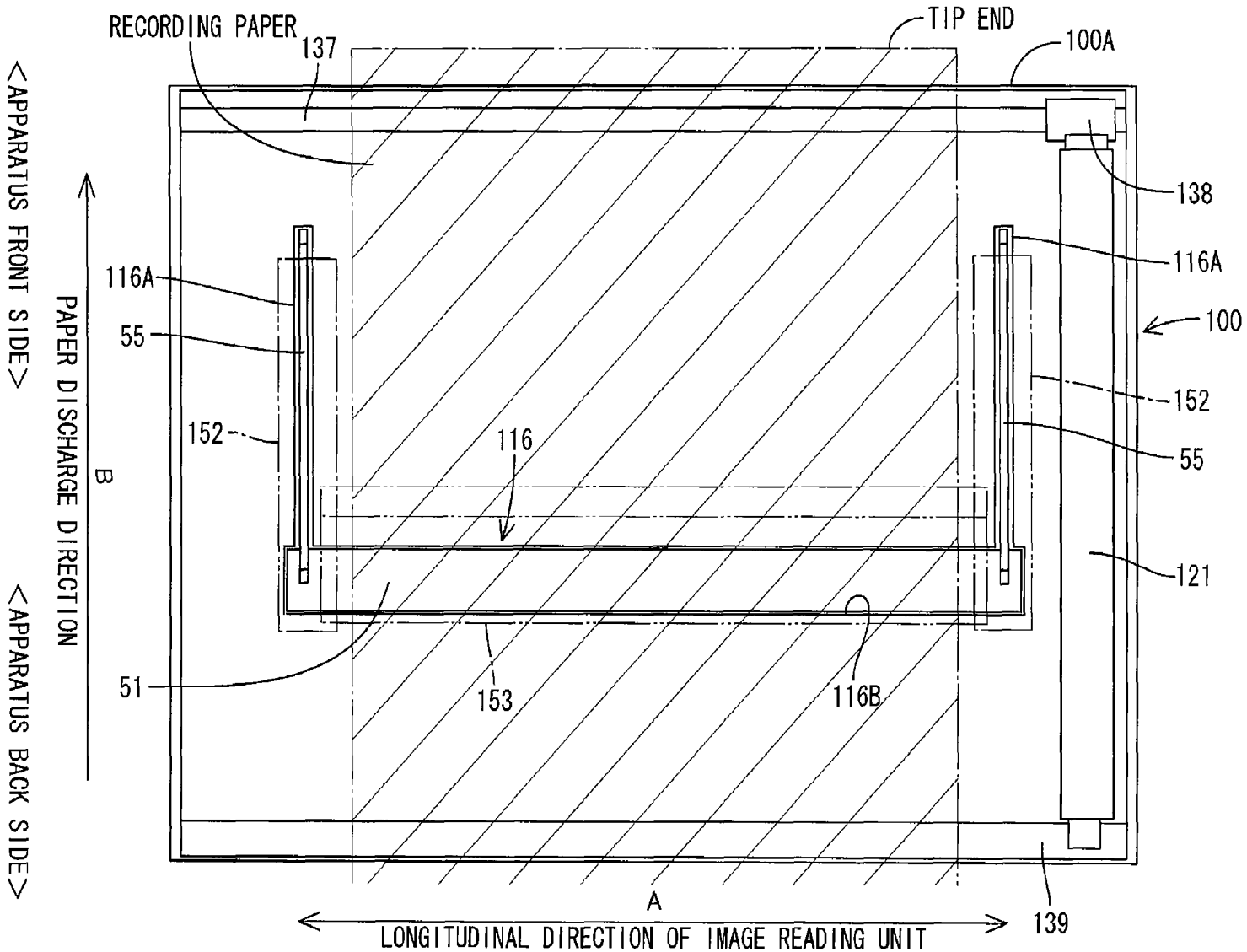
FIG. 7 is a plan view showing a state in which a front end of recording paper protrudes from an image reading unit.

While the image reading unit 100 is fixed with the longitudinal direction of the platen glass 115 on which the original is rested and placed being along the width direction of the apparatus as shown in FIG. 1, the recording paper is discharged toward the front side from the back side of the apparatus. As shown in FIG. 7, the image reading unit 100 is disposed with its longitudinal direction perpendicular to the discharge direction (direction B) of the recording paper. With such a construction, the tip end of the recording paper protrudes from a front end 100A of the image reading unit 100 after being discharged, and therefore, the recording paper can be easily taken in one's hand by just picking up the protruding tip end.

Since the recording paper is discharged toward the front from the back side of the apparatus as described above, an operator performs an operation of taking the recording paper from the front side of the apparatus, and other than this, the multifunctional machine 1 is designed so that the panel operation of the operation panel 145, the attaching and detaching operation of the medium cassette 21, and the attaching and detaching operation of the process unit 30 are performed by operations from the front side of the apparatus. Since the access direction to the apparatus is unified to be the front side like this, the apparatus is excellent in usability.

In addition, when the process unit 30 is attached and detached, it is necessary to cause the LED array 50 to perform a retreat action to the retreat position (the position shown in FIG. 6) from the exposure position (the position shown in FIG. 1), and this is linked to the opening operation of the front cover 17. Such a construction dispenses with a special operation for retreating the LED array 50. Therefore, it becomes possible to complete a removing operation of the process unit 30 with fewer number of operations.

Figure 8:
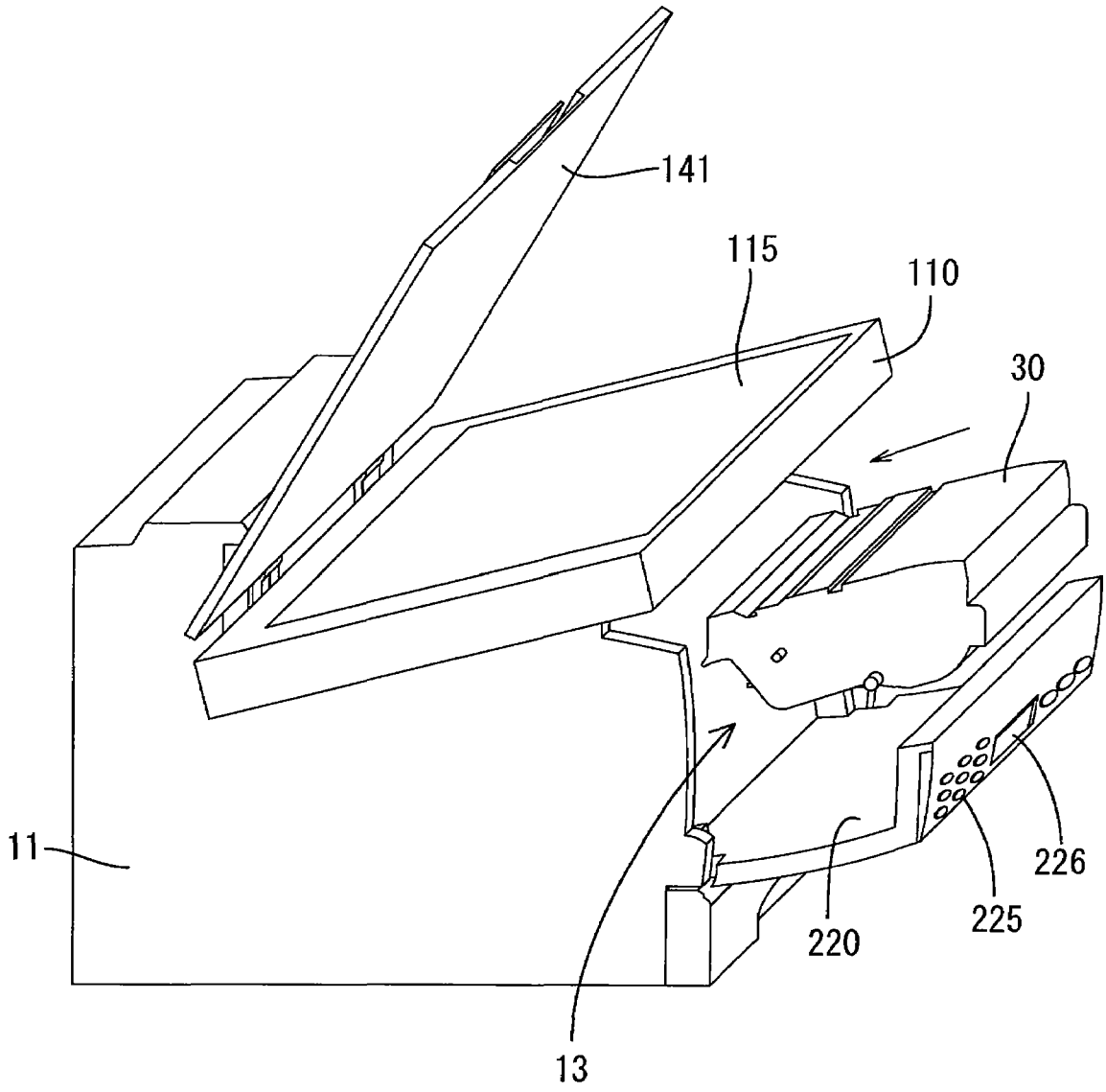
FIG. 8 is a perspective view showing an overview construction of a multifunctional machine according to another mode.
Figure 9:
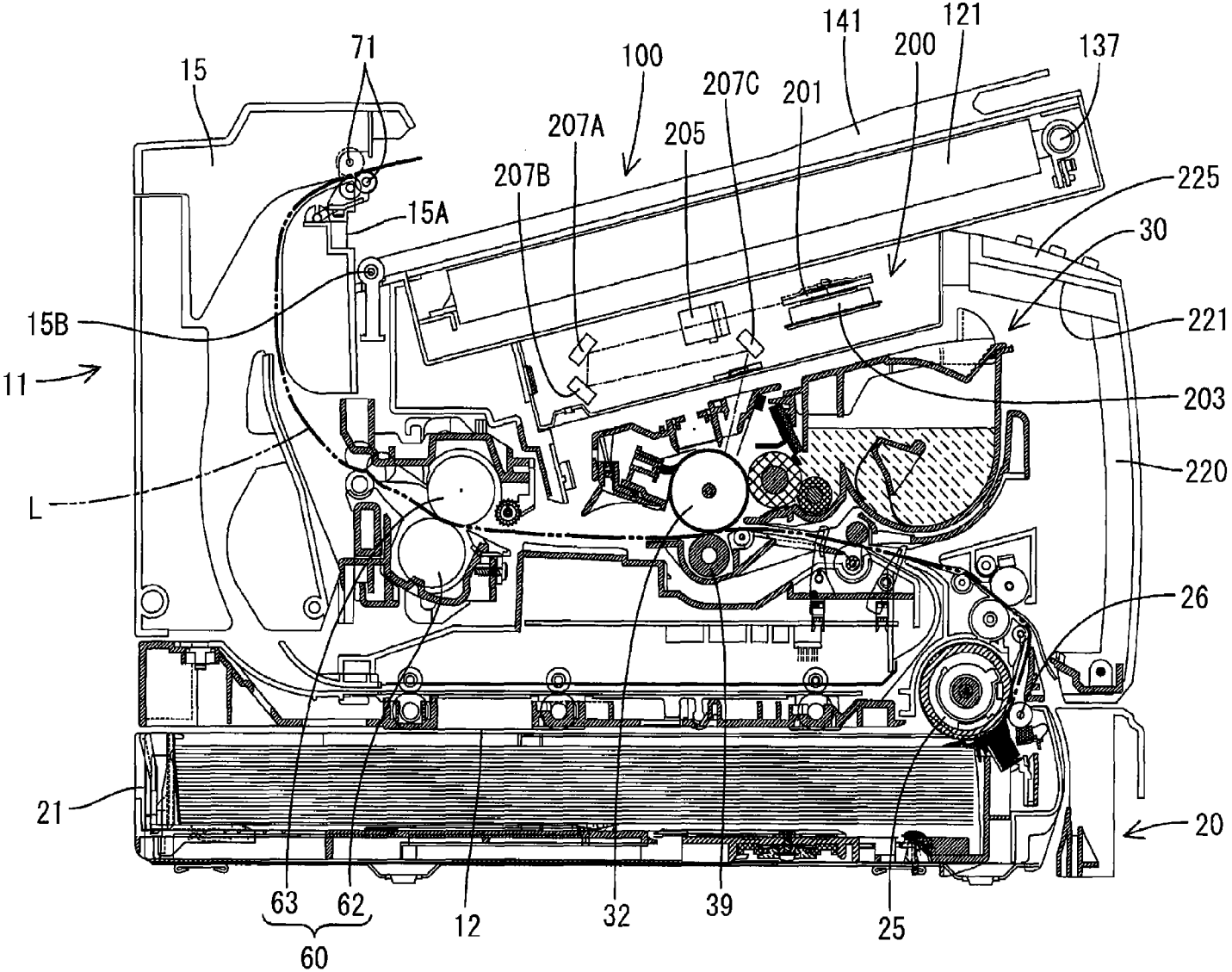
FIG. 9 is a vertical sectional view of the multifunctional machine.

Next, another illustrative aspect of the present invention will be described in accordance with FIGS. 8 and 9.

In this illustrative aspect, the construction of the exposing device is changed with respect to the previous illustrative aspect. Other constructions that are the same as those in the previous illustrative aspect will not be described herein. An exposing device 200 is provided over the process unit 30 in the body case 11, and can include a laser light emitting part (not shown), a polygon motor 203, a polygon mirror 201, a lens 205, reflectors 207A to 207C, and the like.

The laser beam emitted from the laser light emitting part is reflected in a predetermined direction with the polygon mirror 201 driven by the polygon motor 203. The reflected light that passes through the lens 205 is reflected by the respective reflectors 207A to 207C, and emitted onto the surface of the photosensitive drum 32 via a route shown by the dashed line in FIG. 9. Thereby, the photosensitive drum 32 can be exposed.

The apparatus using laser light as this illustrative aspect is excellent in straight-ahead traveling property of light as compared with LED. Therefore, it is not necessary to position the emission port close to the photosensitive drum 32 as the LED array 50, and the exposing device 200 does not interfere with attaching and detaching operations of the process unit 30. As a result, the introduction link 161 and the linkage link 171 in the previous illustrative aspect are not needed.

In the apparatus of this illustrative aspect, an upper wall 221 is positioned on a front cover 220, and an operation panel 225 and a display part 226 are disposed thereon.

The present invention is not limited to the illustrative aspects described by the above description and drawings, but, for example, the following illustrative aspect is possible.

The previous illustrative aspect includes a configuration in which the LED array 50 is automatically retreated into the housing case 110 as a result of the opening operation of the front cover 17, but the LED array 50 may be retreated by a separate operation from that of opening the front cover 17. Namely, the construction is such that the introduction link 161 and the linkage link 171 are abolished, and a special retreat mechanism is provided for the LED array 50.

What is claimed is:

1. An image forming apparatus comprising:

an image forming unit for forming an image on a recording medium including a body case including a process unit removal port on a front surface;

a process unit including an image carrier, wherein the process unit is attachably and detachably mounted to an inside of said body case;

a front cover that opens and closes the process unit removal port of said body case;

a medium cassette that is positioned at said body case, and houses said recording medium in a stacked state with its longitudinal direction being along a depth direction of the apparatus;

an exposing device positioned inside said body case, the exposing device including a light source, wherein the exposing device is able to perform an exposure of said image carrier; and a developing device that is positioned inside said body case, and transfers an image carried by said image carrier to said recording medium;

an image reading unit positioned over said image forming unit, the image reading unit including;

an original placing part on which an original for reading an image is placed;

a reading device that is provided under said original placing part, the reading device able to read said original;

an original cover that presses the original placed on said original placing part from above; and a medium discharge mechanism that is positioned above said original cover and discharges said recording medium onto said original cover from a back side of the apparatus toward a front.

2. The apparatus according to claim 1, wherein said image reading unit is positioned at said body case in an orientation in which it inclines downward to a back side from a front side of the apparatus.

3. The apparatus according to claim 1, wherein said image reading unit is positioned at said body case in an orientation in which a longitudinal direction of the original placing part is along a width direction of the apparatus, and a discharge direction of said recording medium and the longitudinal direction of the original placing part are positioned to be perpendicular to each other.

4. The apparatus according to claim 3, wherein said image reading unit includes a casing that includes said reading device, a receiving port, and a bottom surface, further wherein the receiving port is opened in a bottom surface of the casing, and said image forming unit is provided with a light source support part that supports a light source of said exposing device which is moveable to an exposure position opposite said image carrier and to a retreat position entering an inside of said casing from the exposure position through said receiving port.

5. The apparatus according to claim 4, an advancing and retreating mechanism that moves said reading device in a width direction of the apparatus, the advancing and retreating mechanism allowing the reading device to perform a reading operation and moving said reading device to a side edge portion in said casing thereby opening a central portion of an internal space of the casing, and said light source retreats to a portion which is opened by said advance and retreat mechanism, of the portion being in the internal space of said casing.

6. The apparatus according to claim 4, wherein said light source support part rotationally displaces said light source to said exposure position and said retreat position by a rotational operation around a hinge, and further includes a linking mechanism that engages with said arm support part to rotate the arm support part, and thereby displaces said light source to said retreat position from said exposure position.

7. The apparatus according to claim 4, wherein said light source is a plurality of LEDs.

8. The apparatus according to claim 5, wherein said light source is a plurality of LEDs.

9. The apparatus according to claim 6, wherein said light source is a plurality of LEDs.

10. An image forming apparatus comprising:

a body case;

a process unit including an image carrier, the process unit positioned inside said body case;

a medium cassette that is positioned at said body case, and includes recording medium in a stacked state with its longitudinal direction being along a depth direction of the apparatus;

an exposing device positioned inside said body case, the exposing device includes a light source and performs an exposure of said image carrier;

a developing device that is positioned inside said body case, and transfers an image carried by said image carrier to a recording medium; and an image reading unit that is positioned over said process unit in a state in which it inclines downward to a back side from a front side of the apparatus, the image reading including;

an original placing part on which an original for reading an image is placed;

a reading device positioned under said original placing part to read said original; and an original cover that presses the original placed on said original placing part from above;

a medium discharge mechanism that is positioned above said original cover and discharges said recording medium onto said original cover from the back side of the apparatus toward the front.

11. The apparatus according to claim 10, wherein said image reading unit is positioned at said body case in an orientation in which a longitudinal direction of the original placing part is along a width direction of the apparatus, and a discharge direction of said recording medium and the longitudinal direction of the original placing art are positioned to be perpendicular to each other.

12. The apparatus according to claim 11, wherein said image reading unit includes a casing that includes said reading device, a receiving port, and a bottom surface, wherein the receiving port is opened in the bottom surface of the casing, and said process unit is provided with a light source support part that supports a light source of said exposing device to be displaceable to an exposure position opposed to said image carrier and to a retreat position entering an inside of said casing through said receiving port from the exposure position.

13. The apparatus according to claim 12, wherein an advancing and retreating mechanism that advances and retreats said reading device in a width direction of the apparatus to cause it to perform a reading operation at an original reading time, and at other times, causes said reading device to stay at a side edge portion in said casing to open a central portion of an internal space of the casing is further provided inside said casing, and said light source retreats to a portion, which is opened by said advance and retreat mechanism, of the internal space of said casing.

14. The apparatus according to claim 13, wherein said light source support part rotationally displaces said light source to said exposure position and said retreat position by a rotational operation around a hinge, and further includes a linking mechanism that engages said arm support part to rotate the arm support part, and thereby, displaces said light source to said retreat position from said exposure position.

15. An image forming apparatus comprising:

a body case;

a process unit that has an image carrier, the process unit positioned inside said body case;

a medium cassette that is positioned at said body case, and houses recording medium in a stacked state with its longitudinal direction being along a depth direction of the apparatus;

an exposing device that is positioned inside said body case, the exposing device including a light source, which is able to perform an exposure of said image carrier; and a developing device that is positioned inside said body case, and transfers an image carried by said image carrier to said recording medium; and an image reading unit that is positioned over said process unit, the image reading unit including:

an original placing part on which an original for reading an image is placed, wherein the original placing part is supported in an orientation in which its longitudinal direction is along a width direction of the image forming apparatus;

a reading device that is provided under said original placing part to read said original;

an original cover that presses the original placed on said original placing part from above; and a medium discharge mechanism that is positioned above said original cover, and discharges said recording medium onto said original cover from a back side of the apparatus toward a front in a direction perpendicular to the longitudinal direction of the original placing part.

16. The apparatus according to claim 15, wherein said image reading unit includes a casing that includes said reading device, a receiving port, and a bottom surface, wherein the receiving port is opened in the bottom surface of the casing, and said process unit is provided with a light source support part that supports a light source of said exposing device which is moveable to an exposure position opposite said image carrier and to a retreat position entering an inside of said casing through said receiving port from the exposure position.

17. The apparatus according to claim 16, wherein an advancing and retreating mechanism moves said reading device in a width direction of the apparatus, the advancing and retreating mechanism allowing the reading device to perform a reading operation and moving said reading device to a side edge portion in said casing thereby opening a central portion of an internal space of the casing, and said light source retreats to a portion which is opened by said advance and retreat mechanism, the portion being in the internal space of said casing.

18. The apparatus according to claim 17, wherein said light source support part rotationally displaces said light source to said exposure position and said retreat position by a rotational operation around a hinge, and further includes a linking mechanism that engages said arm support part to rotate the arm support part, and thereby, displaces said light source to said retreat position from said exposure position.

19. An image forming apparatus comprising:

a body case, a process unit that has an image carrier, and is provided inside said body case, a medium cassette that is provided at said body case, and houses recording medium in a stacked state with its longitudinal direction being along a depth direction of the apparatus, an exposing device that is provided inside said body case, has a light source, and performs exposure of said image carrier, and a developing device that is provided inside said body case, and transfers an image carried by said image carrier to said recording medium fed out of said medium cassette, and an image reading unit that is provided at said body case to be laid over said process unit, the image reading unit including the following elements;

an original placing part on which an original for reading an image is placed, a reading device that is provided under said original placing part to read said original, a casing that covers a lower side of said reading device, with a receiving port opened in an undersurface, an original cover that presses the original placed on said original placing part from above, and a medium discharge mechanism that is provided above said original cover, and discharges said recording medium, on which an image is formed by said process unit, onto said original cover from a back side of the apparatus toward a front, and a light source support part that is provided at said process unit, and supports said light source of said exposing device to be displaceable to an exposure position opposed to said image carrier and to a retreat position entering an inside of said casing through said receiving port from the exposure position.

20. The apparatus according to claim 19, wherein said light source is an LED array formed by assembling a plurality of LEDs.

* * * * *